United States Patent [19]

Meshoulam

[11] 4,384,183

[45] May 17, 1983

[54] REMOTE CONTROLLED SOUND MUTING DEVICE

[76] Inventor: Uriel Meshoulam, 321 Harvard St., Cambridge, Mass. 02139

[21] Appl. No.: 251,196

[22] Filed: Apr. 6, 1981

[51] Int. Cl.[3] ..... H01H 35/38

[52] U.S. Cl. ..... 200/82 R; 200/81 H; 200/153 LB

[58] Field of Search ..... 307/118; 340/626; 200/291, 318, 323-325, 81 R, 81 H, 82 R, 83 C, 200/83 Z, 153 LB, 153 LA, 51 R

[56] References Cited

U.S. PATENT DOCUMENTS

| | | | |
|---|---|---|---|
| 2,838,629 | 6/1958 | Panzenhagen | 200/83 Z |
| 3,488,464 | 1/1970 | Hocking | 200/81 H |
| 3,781,743 | 12/1973 | Kolbow | 200/83 Z |
| 4,150,264 | 4/1979 | Lieberman | 200/81 H |

FOREIGN PATENT DOCUMENTS

| | | | |
|---|---|---|---|
| 262429 | 6/1968 | Austria | 200/83 Z |
| 1905386 | 8/1970 | Fed. Rep. of Germany | 200/83 Z |
| 636954 | 4/1928 | France | 200/83 Z |

*Primary Examiner*—G. P. Tolin
*Attorney, Agent, or Firm*—Joseph S. Iandiorio

[57] ABSTRACT

A remote controlled sound muting device for operating an audio jack switch including cam means for inserting in and operating an audio jack switch; means for driving the cam means to alternate between a first position to open the audio jack switch and a second position to close the audio jack switch; and remote actuator means for operating the cam means.

12 Claims, 6 Drawing Figures

REMOTE CONTROLLED SOUND MUTING DEVICE

FIELD OF INVENTION

This invention relates to a remote controlled sound muting device for operating an audio jack switch.

BACKGROUND OF INVENTION

While watching television or listening to an audio appliance such as a radio, stereo, or tape recorder, a viewer or listener may wish to temporarily eliminate the device's volume without cutting off its power. For example, the listener may not desire to listen to a commercial advertisement. Or he may wish to engage in a conversation, answer the telephone, or perform some other activity in silence before returning to listening to the audio appliance. A remote controlled sound muting device will allow the listener to dim the audio for these purposes and later restore the sound without having to leave his viewing or listening position in order to act directly upon the appliance.

Typically, such remote controlled sound muting devices have involved complex electrical or photoelectrical systems. Installation of such a device is fairly expensive and involves some knowledge of electricity. Alternatively, relatively simple remote controlled devices have been developed which will cut off the entire power to the appliance. These devices are inefficient, however, where only a brief temporary silence is required or where other non-auditory functions of an appliance are not to be cut of, e.g. T.V. picture.

Audio jack switches have been included in appliances for the purpose of cutting off the power to the appliance's main speaker and channeling it to an auxiliary speaker, typically an earphone. The jack switch has yet to be utilized for the purpose of remotely muting and restoring the sound from the appliance.

SUMMARY OF INVENTION

It is therefore the object of this invention to provide an improved remote controlled sound muting device for operating an audio jack switch which is simple and inexpensive.

It is a further object of this invention to provide a remote controlled sound muting device for operating an audio jack switch which operates totally mechanically.

It is a further object of this invention to provide a remote controlled sound muting device for operating an audio jack switch which may be permanently installed, without making electrical adjustments, by inserting the device in an audio jack.

The invention features a remote controlled sound muting device for operating an audio jack switch which includes cam means for inserting in and operating an audio jack switch. There are means for driving the cam means between a first position to open the audio jack switch and a second position to close the jack switch. Remote actuator means operate the means for driving the cam means. The cam means may include translational cam means which moves longitudinally in and out in the manner of a solenoid, or may be an inflatable member such as a bellows, which when inflated operates the audio switch.

The means for driving the cam means may include ratchet means for rotating the cam means, and a pawl member to engage and restrain the backward motion of the ratchet means. Ratchet drive means drives the ratchet means.

Ratchet drive means may include a reciprocating member. The reciprocating member may include a yoke member having one arm for engaging the ratchet means upon advance of the reciprocating member and another arm for engaging the ratchet means upon retraction of the reciprocating member. The means for driving the cam means may also include a cylinder housing, a piston contained within the cylinder housing and port means for introducing pressure to advance the piston. The reciprocating member may include a non-cylindrical leg driven by the piston, and the cylindrical housing may have a non-circular opening for receiving the leg and preventing axial rotation of the reciprocating member. The means for driving the cam member may include a spring for retracting the reciprocating member. Remote actuator means may include a fluid pressurizing device with the port means to transmit pressure through the port means to the piston. Ratchet means may include spring means to urge the ratchet means to engage and lock with the pawl member. Cam means may have at least two spaced actuating lobes. Ratchet means may include a stem member rotatable with the ratchet means. Cam means may include slotted guide means which is connected to and rotatable with the stem member and may also include a blade having two actuating lobes spaced 180° apart, the blade being inserted in the slot in the guide means.

DISCLOSURE OF PREFERRED EMBODIMENT

Other objects, features and advantages will occur from the following description of preferred embodiments and the accompanying drawings, in which.

A remote controlled sound muting device for operating an audio jack switch according to this invention may be effected using a rotatable cam means. Alternatively, the cam means may operate the audio jack switch by translational motion, i.e. in and out longitudinally instead of rotationally.

A rotatable cam means may include a blade having two actuating lobes spaced 180° apart. In the alternative, the blade may include more than two actuating lobes.

Means for rotating the cam means may include a ratchet means having circumferential teeth and a toothed face which is urged against the toothed face of a circular pawl member to prevent backward rotation. Alternatively, a pawl member may include a latch, teeth, or other means which act directly against the circumferential teeth or other parts of the ratchet means.

Ratchet drive means for driving the rotatable ratchet may include a reciprocating member. The reciprocating member may include a yoke having a first arm for engaging the ratchet upon advance and a second arm for engaging the ratchet upon retraction. Alternatively, the reciprocating member may include only one arm for engaging the ratchet on its advance or retraction.

Means for operating the ratchet drive means may include a pressure powered piston for advancing and a piston return spring for retracting the reciprocating member. The reciprocating member may include a non-cylindrical leg which enters the actuating means through a non-circular opening preventing axial rotation of the reciprocating member.

The remote actuator means may include a pneumatic device having an elastomeric, e.g. urethane, bulb which delivers pressurized air through a vinyl or rubber tube and an inlet port to the piston. Alternatively, the remote actuator means may include an electric or hydraulic device.

Figure 1:
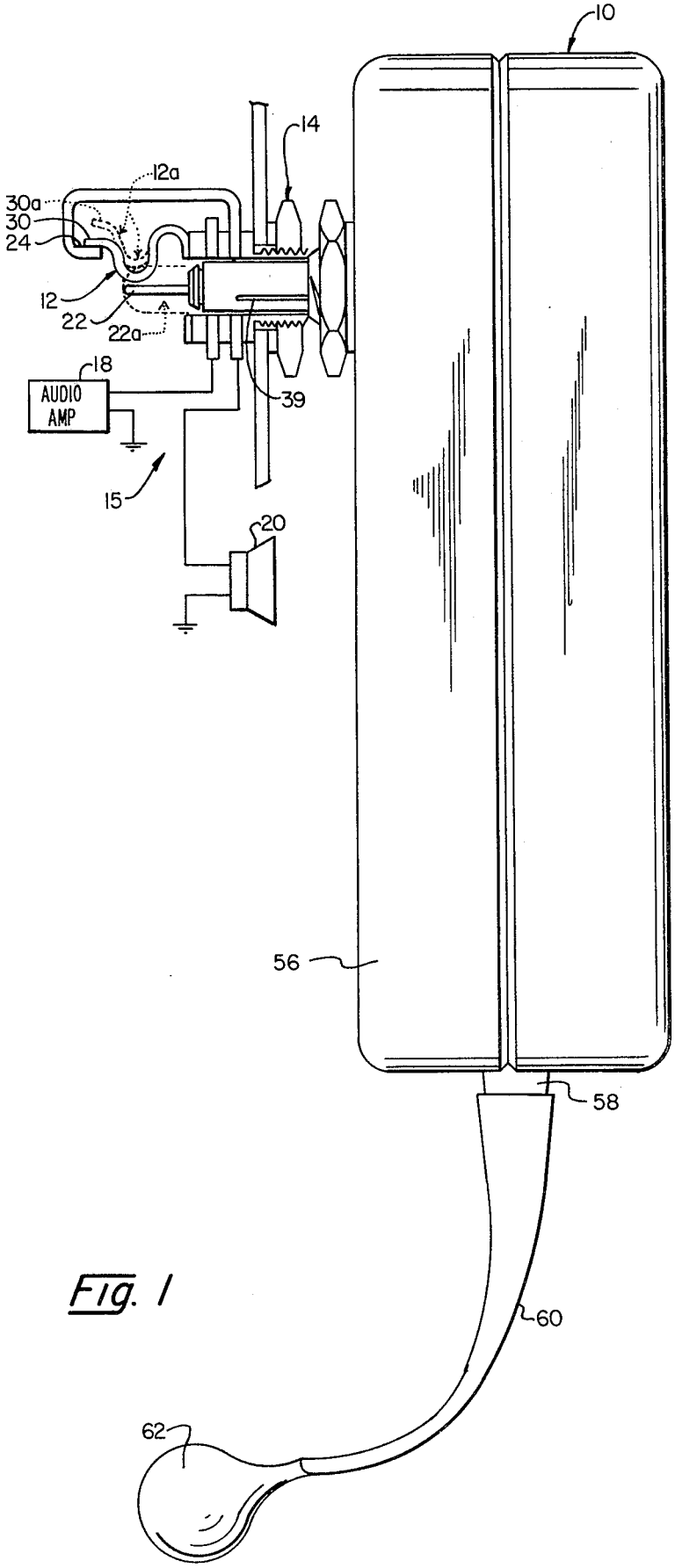
FIG. 1 is a side elevational view of a remote controlled sound muting device for operating an audio jack switch according to this invention, inserted in such an audio jack, and a schematic view of the electrical circuit to which the audio jack switch is connected.

There is shown in FIG. 1 a remote controlled sound muting device 10 for operating an audio jack switch 12 according to this invention, which is inserted into audio jack 14. Also shown is a schematic view of the electrical circuit 15 to which switch 12 is connected. Power flows from audio amplifier 18 through the electrical circuit 15 to speaker 20. When cam blade 22 is at a low point, as shown, switch 12 remains closed. When contact 24 is closed on contact 30, power flows through circuit 15 and sound emanates from speaker 20. Rotation of cam blade 22 90° to the phantom position **22*a* enables cam blade 22 to bear on switch 12 and move contact 30 away from contact 24 to phantom position 30*a*, opening switch 12 to the position shown in phantom 12*a*. Power to speaker 20 ceases and the sound is muted. A further 90° rotation of blade 22 from phantom position high point 22*a* to the low point 22 recloses switch 12**, restoring the power and the sound.

Also in FIG. 1 a remote actuator, bulb 62, connected with tube 60, connects to inlet port 58 through housing 56 transmitting pneumatic pressure to drive device 10.

Figure 2:
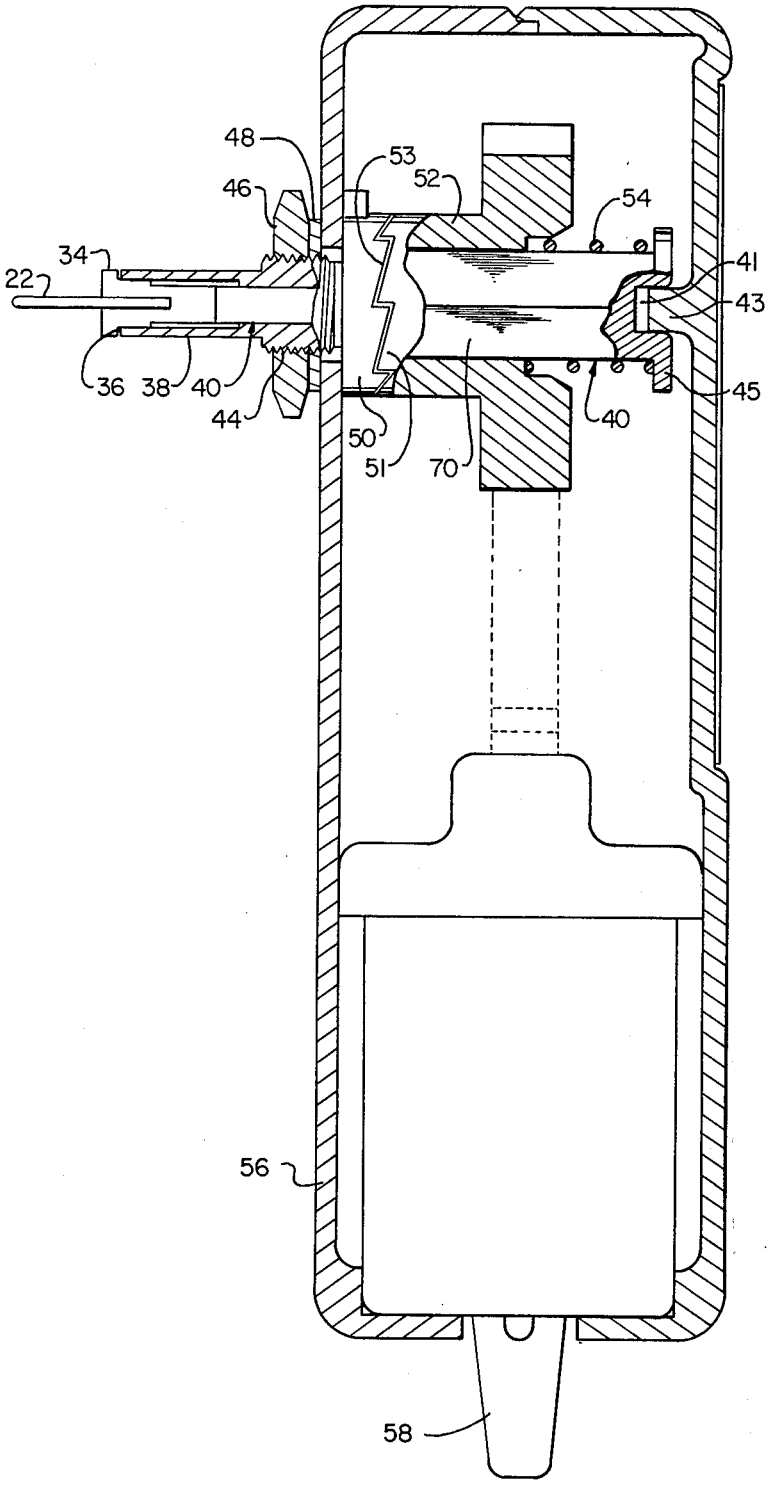
FIG. 2 is a side elevational cross-sectional view of the device of FIG. 1.
Figure 3:
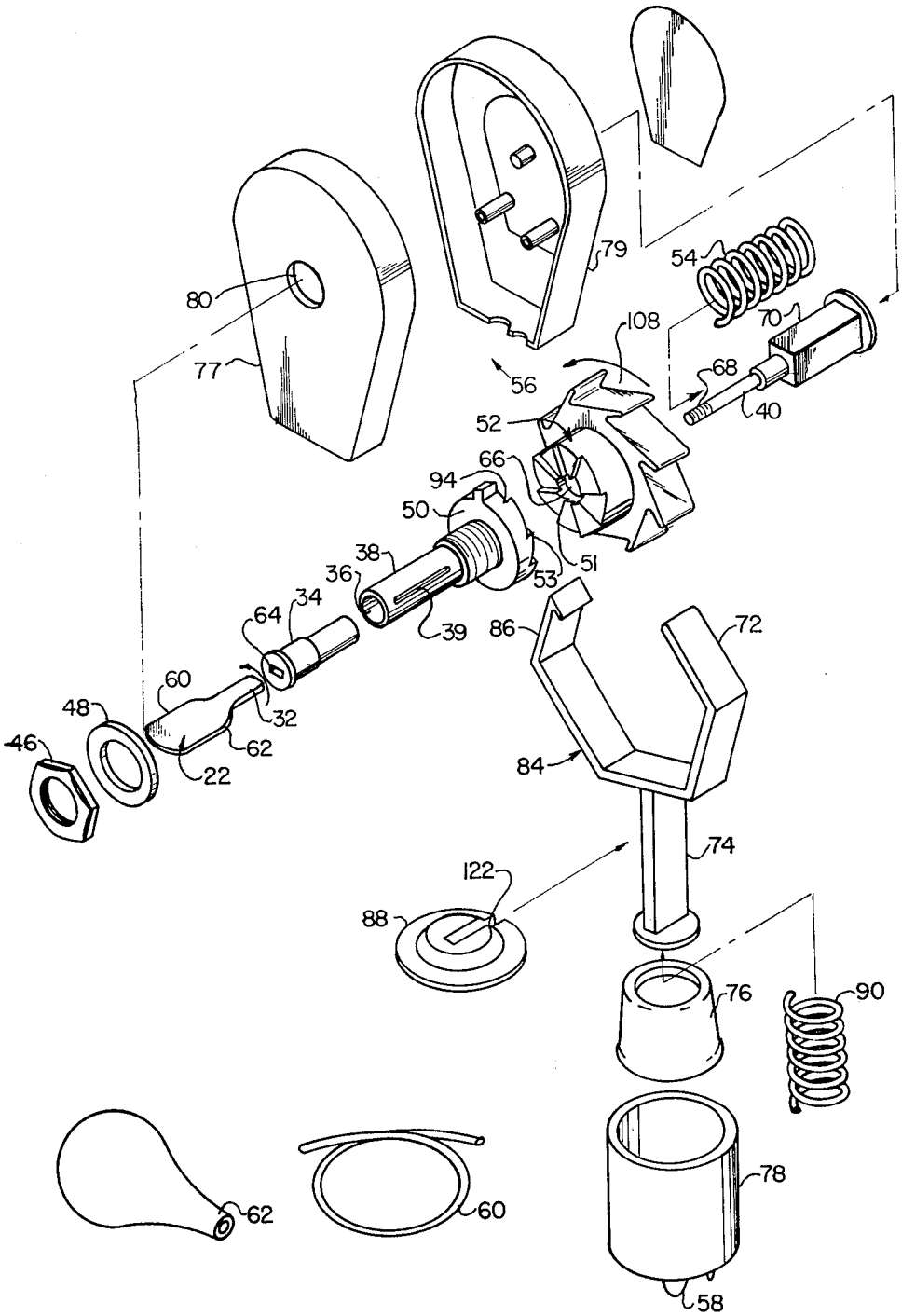
FIG. 3 is an exploded isometric view of the device of FIG. 1.

Blade 22 is received in guide means 34, FIG. 2, which is inserted in an open end 36 of a cylindrical shank 38 having ribs 39. The guide is therein secured to the end of a stem member 40. Shank 38 protrudes from housing 56 and has threads 44 which accommodate nut 46 and washer 48 to secure shank 38 in position. Ribs 39 engage snugly with an audio jack socket to prevent rotation of the entire device 10 when blade 22 rotates. On the end of shank 38 within housing 56 is a pawl member 50. Stem member 40 protrudes through a ratchet 52 and into shank 38. Ratchet 52 surrounds and is keyed to rotate with stem block 70 by the square shape of block 70. Teeth 51 of ratchet 52 are urged, by a spring 54, to engage the teeth of pawl 50. Stem 40 has a hole 41 receiving post 43, which is an extension of housing 56. Hole 41 is urged onto post 43 by spring 54 acting on stem flange 45. Stem 40 thereby sits upon and rotates around post 43. Blade 22 has actuating lobes 60 and 62, FIG. 3, spaced 180° apart. End 32 of blade 22 is received in slot 64 of guide 34. Guide 34 is inserted in opening 36 of shank 38. Stem 40 protrudes through center hole 66 of ratchet 52 and into cylindrical shank 38. Therein guide 34 is connected to threaded end 68 of stem 40. Rotation of ratchet 52 in the direction of arrow 108 rotates stem block 70 and stem 40, which in turn rotates guide 34 and blade 22 in the same direction. Spring 54, disposed about stem block 70, urges teeth 51 against teeth 53, thus preventing backward rotation of ratchet 52. Housing 56 includes two parts 77, 79, with an orifice 80 in part 77 through which shank 38 protrudes.

Reciprocating member, yoke 84, includes a hooked arm 86, an unhooked arm 72 and a leg 74. Leg 74 enters cylinder housing 78 through slot 122 in cap 88 to engage piston 76. Leg 74 is non-cylindrical and slot 122 is non-circular to prevent axial rotation of leg 74. Piston return spring 90 is disposed about leg 74, and bulb 62 is connected to tube 60 which is connected to inlet port 58.

Figure 4:
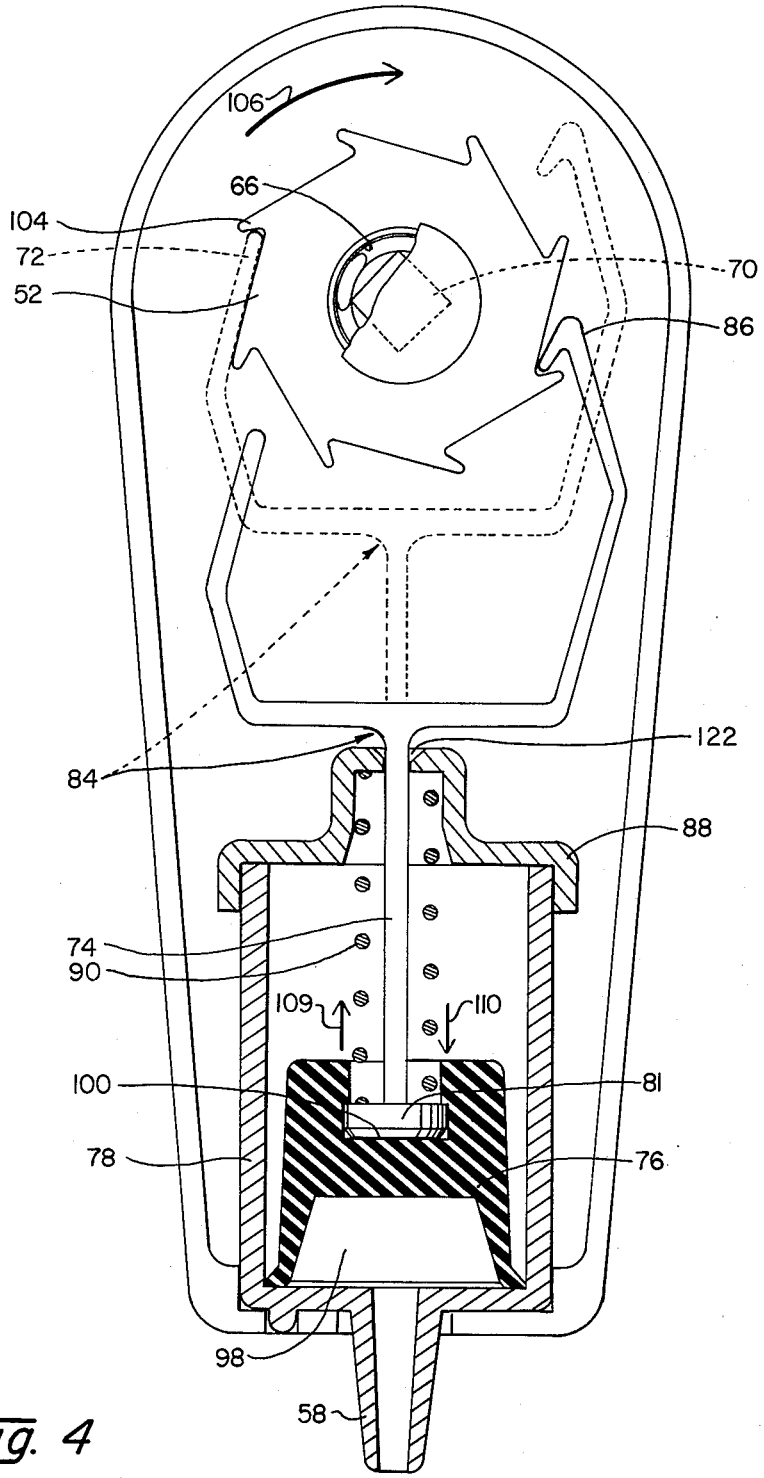
FIG. 4 is a front elevational cross-sectional view of the device of FIG. 1.

In operation, pressure is transmitted through the inlet port 58, FIG. 4, to compartment 98 within cylinder housing 78. As pressure builds in compartment 98 piston 76 is advanced in the direction of arrow 109. Foot 81 of leg 74 is gripped in recess 100 of piston 76. Leg 74 is advanced through slot 122 of cap 88 so that unhooked yoke arm 72 engages ratchet tooth 104 rotating ratchet 52 45° in the direction of arrow 106. Upon decrease of the pressure in compartment 98 a piston return spring 90 retracts piston 76 and leg 74 in the direction of arrow 110 so that hooked yoke arm 86 thereby engages ratchet tooth 107, rotating ratchet 52 an additional 45° in the direction of arrow 106. During each cycle of advance and retraction of yoke 84 ratchet 52 and stem block 70 rotate 90° and thus rotate blade 22 90° to operate the audio jack switch.

Figure 5:
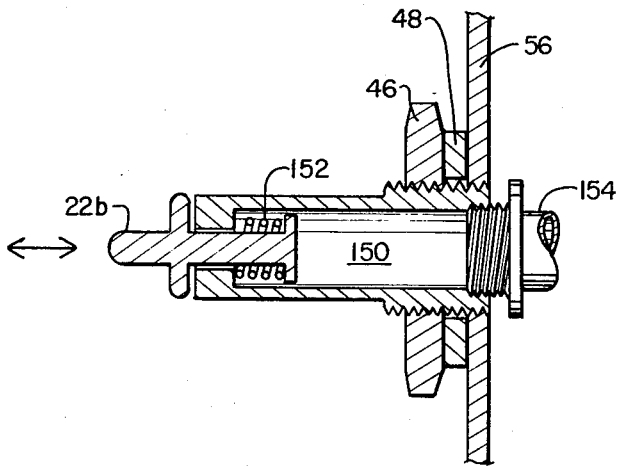
FIG. 5 is a side elevational cross-sectional view of an alternative cam means according to this invention.
Figure 6:
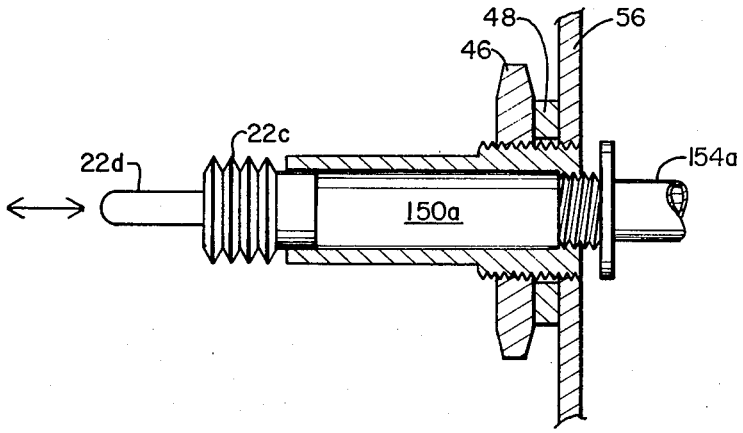
FIG. 6 is a view similar to FIG. 5 of another alternative cam means.

Alternatively, cam means may be implemented using a longitudinal cam member **22*b*, FIG. 5, driven to and fro in cylinder 150 against spring 152 by air pressure introduced through nipple 154 to operate a switch. Similarly, cam means may include a bellows 22*c*, FIG. 6, whose tip 22*d* extends to activate a switch when air pressure is introduced through nipple 154 into cylinder 150*a***.

Other embodiments will occur to those skilled in the art and are within the following claims:

What is claimed is:

1. A remote controlled sound muting device for operating an audio jack switch comprising:

a housing;

a hollow shank extending from and fixed to said housing for extending into the audio jack;

engaging means on said shank for snugly gripping the inside of the audio jack and preventing rotation of the shank;

a cam member rotatably mounted in said shank and extenting beyond the end of said shank into said audio jack to actuate the audio circuit contacts in the audio jack;

a shaft connected to said cam member;

means for driving said shaft in steps to alternately open and close said audio circuit contacts; and remote actuator means for operating said means for driving said shaft.

2. The device of claim 1 in which means for driving includes ratchet means for rotating said shaft; a pawl member for engaging and restraining backward motion of said ratchet means; and ratchet drive means for driving said ratchet means.

3. The device of claim 2 in which said ratchet drive means includes a reciprocating member.

4. The device of claim 3 in which said reciprocating member includes a yoke member having a first arm for engaging said ratchet means upon advance of said reciprocating member and a second arm for engaging said ratchet means upon retraction of said reciprocating member.

5. The device of claim 3 in which said means for driving includes a cylinder housing, a piston contained within said cylinder housing, and port means for introducing pressure to advance said piston.

6. The device of claim 5 in which said reciprocating member includes a non-cylindrical leg driven by said piston and said cylindrical housing includes a non-circular opening for receiving said leg and preventing axial rotation thereof.

7. The device of claim 5 in which said means for driving includes spring means for retracting said piston and reciprocating member.

8. The device of claim 5 in which said remote actuator means includes a fluid pressurizing device and means for connecting said pressurizing device through said port means to said piston.

9. The device of claim 2 in which said ratchet means includes spring means to urge said ratchet means to engage and lock with said pawl member.

10. The device of claim 2 in which said cam means includes at least two spaced actuating lobes.

11. The device of claim 1 in which said cam member includes guide means and said guide means includes a slot therein.

12. The device of claim 11 in which said cam member includes a blade having two actuating lobes spaced 180 degrees apart and said blade is received in said slot in said guide means.

* * * * *